US012458862B1

(12) United States Patent
Burdette

(10) Patent No.: US 12,458,862 B1
(45) Date of Patent: Nov. 4, 2025

(54) GOLF BALL IDENTIFICATION APPARATUS AND SYSTEM

(71) Applicant: Topgolf International, Inc., Dallas, TX (US)

(72) Inventor: Brian David Burdette, McKinney, TX (US)

(73) Assignee: Topgolf International, Inc., Dallas, TX (US)

( * ) Notice: Subject to any disclaimer, the term of this patent is extended or adjusted under 35 U.S.C. 154(b) by 397 days.

(21) Appl. No.: 18/202,178

(22) Filed: May 25, 2023

Related U.S. Application Data

(63) Continuation-in-part of application No. 18/296,897, filed on Apr. 6, 2023, now Pat. No. 11,944,883.

(60) Provisional application No. 63/359,626, filed on Jul. 8, 2022, provisional application No. 63/333,520, filed on Apr. 21, 2022.

(51) Int. Cl.
*A63B 69/36* (2006.01)
*A63B 47/02* (2006.01)

(52) U.S. Cl.
CPC ..... *A63B 69/3658* (2013.01); *A63B 47/025* (2013.01); *A63B 69/3655* (2013.01); *A63B 69/3694* (2013.01); *A63B 2225/15* (2013.01); *A63B 2225/54* (2013.01)

(58) Field of Classification Search
CPC ..... A63B 69/3658; A63B 47/025; A63B 69/3655; A63B 69/3694; A63B 2225/15; A63B 2225/54
USPC ..... 473/134, 136, 150, 151, 153, 155, 196, 473/199
See application file for complete search history.

(56) References Cited

U.S. PATENT DOCUMENTS

| | | | | | |
|---|---|---|---|---|---|
| 4,177,996 | A * | 12/1979 | Chang | A63B 57/0006 | 473/134 |
| 5,653,642 | A * | 8/1997 | Bonacorsi | A63B 71/0669 | 473/153 |
| 6,607,123 | B1 * | 8/2003 | Jollifee | A63B 57/0006 | 235/375 |
| 6,685,575 | B1 * | 2/2004 | Anderson | A63B 57/0006 | 473/137 |
| 7,337,965 | B2 * | 3/2008 | Thirkettle | G06K 7/08 | 273/317.2 |
| 9,468,828 | B2 * | 10/2016 | Bush | A63B 57/40 | |
| 10,546,467 | B1 * | 1/2020 | Luciano, Jr. | G07F 17/3295 | |
| 2012/0052967 | A1 * | 3/2012 | Grieshaber | A63B 63/00 | 473/409 |

* cited by examiner

*Primary Examiner* — Nini F Legesse
(74) *Attorney, Agent, or Firm* — Michael A. Catania

(57) ABSTRACT

A golf ball identification apparatus and system for is disclosed herein. The golf ball identification apparatus includes a housing, a cover, a helical track within the housing, and an antenna. The antenna is positioned at a bottom of the housing and is configured to identify a golf ball that has a wireless identification device.

14 Claims, 9 Drawing Sheets

GOLF BALL IDENTIFICATION APPARATUS AND SYSTEM

CROSS REFERENCES TO RELATED APPLICATIONS

The Present Application claims priority to U.S. Provisional Patent Application No. 63/359,626, filed on Jul. 8, 2022, and the Present Application is a continuation-in-part application of U.S. patent application Ser. No. 18/296,897, filed on Apr. 6, 2023, which claims priority to U.S. Provisional Patent Application No. 63/333,520, filed on Apr. 21, 2022, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to an apparatus for identifying a golf ball from a wireless signal from an integrated RFID component.

Description of the Related Art

The game of golf has a long history, and in addition to traditional golf played on golf courses, driving ranges have been used by players to improve their game. Further, golf facilities have been developed in which golf balls with RFID tags are hit into targets that include RFID readers, allowing the creation of interactive golf games, where the successful hitting of a target with a golf ball is automatically identified in a computer system and reported back to the golfer to create a more exciting golf experience. This has encouraged new players to learn golf, resulting in a substantial increase in the interest in golf generally. Moreover, such golf facilities have experienced wide and growing popularity, which results in many millions of golf balls with RFID tags being hit each year.

Thirkettle et al, U.S. Pat. No. 7,337,965 for a Ball Identifying Device, discloses a device for reading coded golf balls using a helical track.

BRIEF SUMMARY OF THE INVENTION

One aspect of the present is a system for identifying a golf ball hit on a range having multiple targets. The system comprises s target collection member positioned on the range, a ball detection member, and an antenna. The ball detection member comprises a housing, a cover, and a helical track within the housing. The cover comprises a plurality of holes for access to the helical track. The antenna is positioned at a bottom of the housing. The antenna is configured to detect a golf ball comprising a wireless transmitter.

Another aspect of the present invention is a golf ball identification apparatus comprising a housing, a cover, a helical track within the housing, and an antenna. The cover comprises a plurality of holes for access to the helical track. The antenna is positioned at a bottom of the housing. The antenna is configured to detect a golf ball comprising a wireless transmitter.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 18:
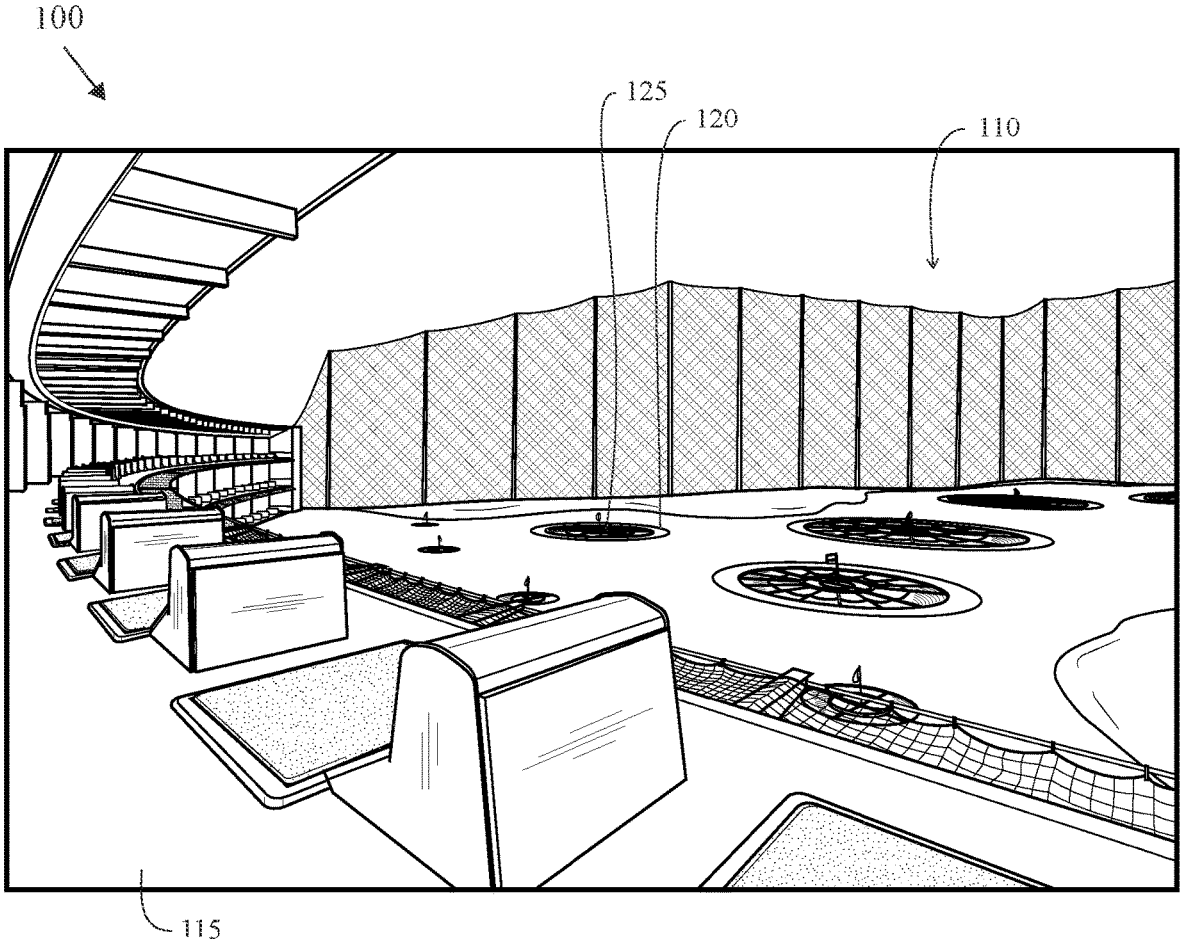
FIG. 18 is an illustration of a golf facility of the invention.

FIG. 18 shows an example of a golf facility 100 including targets 120 for RFID equipped golf balls. The golf facility 100 includes a golf range 110 and a building 115. The golf range 110 can be of various shapes and sizes, but will typically be 300-500 feet wide and 600-900 feet long. The golf range 110 can be flat or include small hills or one or more inclines, and can also include hazards, such as water and sand traps. Note that such hazards need not include actual water and sand, but can simply be colored to look like water or sand. Moreover, the golf range 110 can be composed of real grass or artificial turf.

Included in the golf range 110 are targets 120 having different sizes and being different distances from the building 115, where people stand to hit golf balls toward the targets. The targets can be grouped into distance categories that generally represent their distance from the building 115, and the targets can have various shapes, such as the circular shapes of the main targets and the rectangular shape of the trench target at the end of the range 110. Other shapes for the targets 120, as well as different numbers of targets 120 than shown, are also possible.

Figure 19:
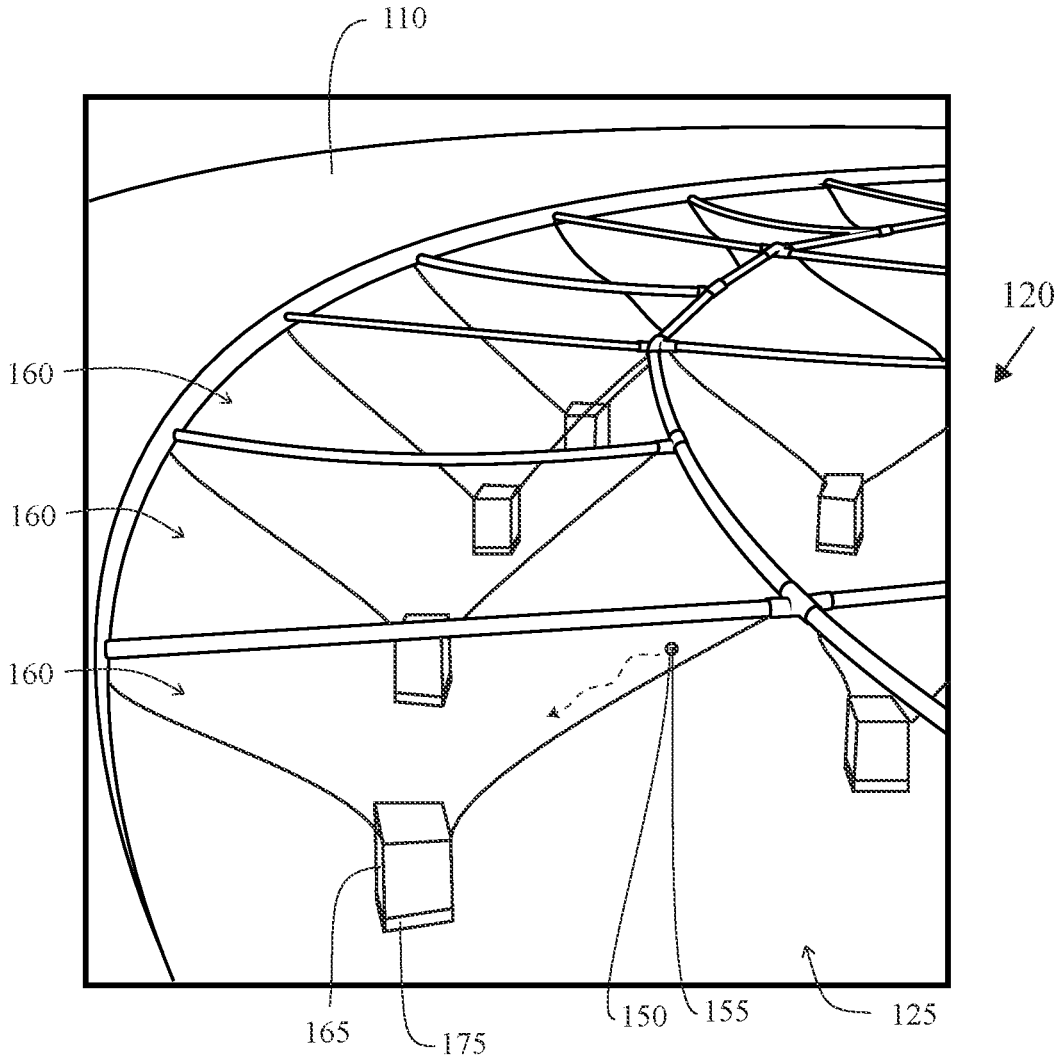
FIG. 19 is a detailed view of a target of the invention.

Each target 120 includes one or more systems 125 for receiving and identifying the golf balls that enter the target 120. For example, each target can include netting that funnels the golf balls into a nearest receiver box which is part of a system 125, where RFID tags inside the balls are read as each ball passes through the receiver box. Each receiver box can be equipped with an RFID antenna that is connected with an RFID reader, which in turn is connected with a computer system for the golf facility 100 that manages the golf games. Moreover, one or more of the targets 120 can include discrete sections of nets such that information regarding which portion of the target a particular golf ball lands in can be determined, and different points or game features can be applied accordingly, as shown in FIG. 19. Each such net section 160 can have its own receiver box 165 and RFID antenna, and multiple such antennas inside a target 120 can have their signals be multiplexed into a single RFID reader to reduce the total number of RFID readers needed for the golf facility 100.

Once the golf balls are read and collected within each target 120, they can be manually or automatically returned to the building 115 for another hit. For example, each target can include a collection point that includes a helical screw to capture and direct the golf balls to a vacuum intake point where the golf balls can be individually sucked through pneumatic tubes back to the building 115. Moreover, the golf balls can be individually washed and read again by an additional RFID equipped receiver at the building 115 before being placed back into play.

FIG. 19 shows an example of a system 125 for receiving and identifying RFID equipped golf balls, as can be used in the golf facility 100. Each golf ball 150 includes an RFID tag 155. As will be appreciated, various RFID structures and designs can be used, but the RFID tag 155 will generally not be visible as it is embedded in the golf ball 150 . . . . Moreover, each of the golf balls discussed below is an RFID equipped golf ball. As the golf ball 150 lands in the netting of a target 120, the netting (a target net 160 or target net section 160) funnels the golf ball into a golf ball receiving apparatus 165. Further, in some implementations, the balls 150 that pass through the apparatus 165 are then routed through one or more tubes back to the building 115.

Inside the receiving apparatus 165, the ball 150 rolls and/or bounces past an RFID antenna 175 that is connected to an RFID reader. The RFID antenna 175 obtains wireless signals responsive to the tag 155 in the ball 150, and the RFID reader processes these signals to determine the identification data of the ball 150 and forwards that data to the facility's back-end software, to determine which target 120 (or which zone of the target 120) the specific ball entered, from which data a score and/or game occurrence can be determined. Further data (beyond the RFID tag's unique number) can also be sent to the facility's back-end software, including signal strength (RSSI), timestamp, RFID channel (radio frequency), and antenna number. Note that the receiving apparatus 165 includes an antenna 175, but need not include control circuitry. Rather, the antenna 175 can be connected to the RFID reader using a wire, and all control circuitry that implements the RFID functionality can be remote from the receiving apparatus 165.

Nonetheless, in some implementations, some or all of the control circuitry is integrated into the receiving apparatus 165. The antenna 175 can be separate from the control circuitry or integrated into the control circuitry. In some implementations, the antenna 175 is outside the receiving apparatus 165 rather than inside. In some implementations, the antenna and control circuitry are built into a single integrated circuit module that is embedded in the receiving apparatus 165. Thus, as used herein, an RFID antenna can refer to an RFID chip or other compact electronics package. Moreover, the antenna 175 can be placed in various positions, as described in detail below, and in some implementations, more than one antenna 175 can be used. For example, a first RFID antenna 175 can have a first orientation, and a second RFID antenna 175 can have a second orientation that is 90 degrees away from the first orientation, which improves the chances of reading the golf ball's embedded RFID tag.

The antenna 175 can be near-fielded and have a polarization type, e.g., linear or circular type polarization. In addition, the antenna 175 can be accompanied by a wall or walls made of RF shielding or absorbing material(s) to reduce RF interference. Moreover, various RFID technologies can be used in various implementations, including passive or active RFID, read-only, field-programmable or read/write RFID tags, and different frequency bands can be used to achieve different ranges and data speeds (e.g., Low Frequency (LF) from 120-150 kHz, High Frequency (HF) around 13.56 MHz, and Ultra High Frequency (UHF) about 433 MHz or 865-868 MHz or 902-928 MHz). In general, more durable but also less expensive RFID tags 155 should be used given the regular, large impacts that are experienced by the golf balls 150 in which they are embedded.

The RFID reader can cause the antenna 175 to transmit a radio signal (e.g., an encoded radio signal) to interrogate the RFID tag 155. The RFID tag 150 receives the signal and then responds with identification and potentially other information. While it can be a single box attached to the golf ball receiving apparatus 165, it will be appreciated that the RFID reader 180 can be distributed among two or more locations. For example, each target net section 160 can have its own receiving apparatus 165 that includes one or more antennas that are electrically connected with one or more RFID reader circuits located elsewhere. Thus, the RFID reader 180 can be connected with multiple antennas and can operate all of the connected antennas. Various other combinations of RFID antennas and reader circuitry/processors can be used with each target, depending on the size of the target and the number of golf balls 150 to be read in a given period of time (e.g., based on average or peak ball volume).

Figure 1:
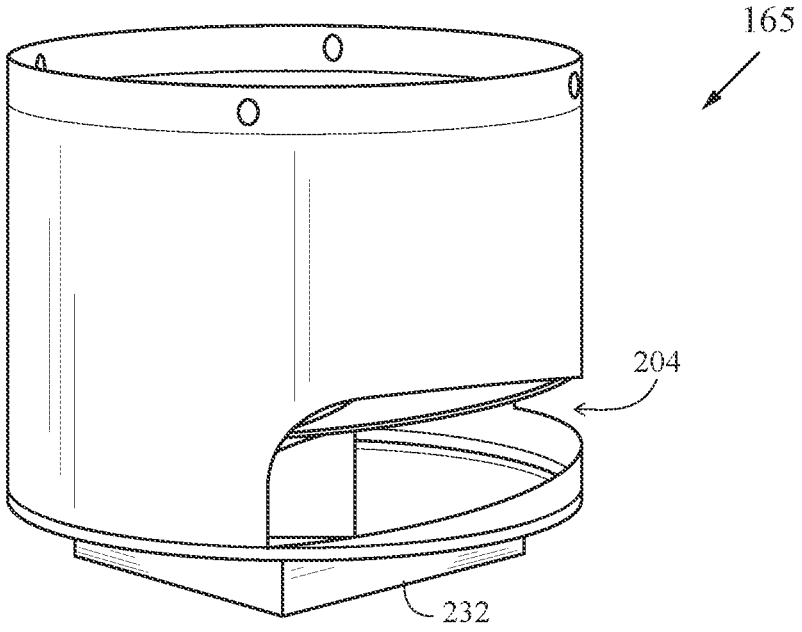
FIG. 1 is a perspective view of an embodiment of the invention.
Figure 2:
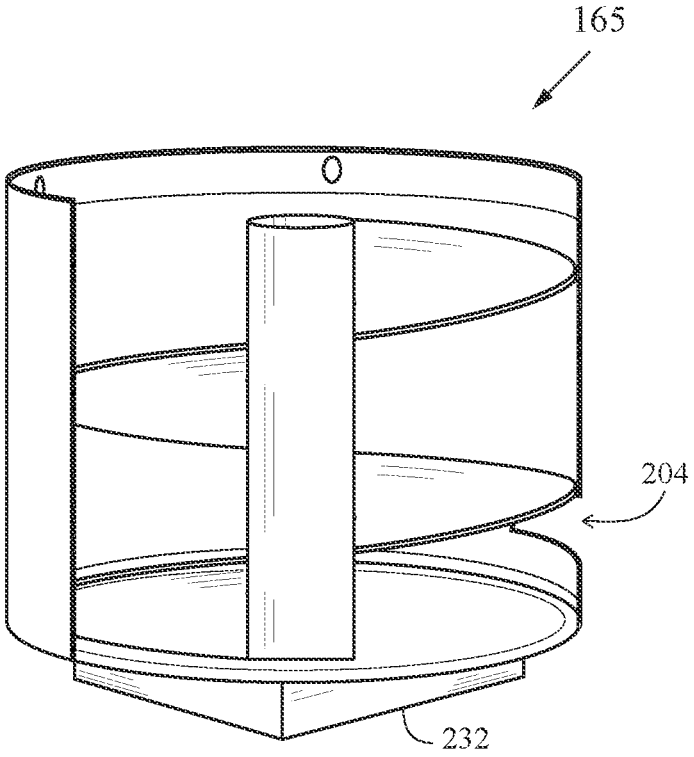
FIG. 2 is a perspective cutaway view of the embodiment of FIG. 1.

An embodiment of an auger ball receiving apparatus 165 is shown in FIGS. 1 and 2, with a cylindrical body and a bottom mounted antenna 232. The golf balls 150 leave the apparatus 165 through the egress 204. The screw shape encourages random movement.

Figure 3:
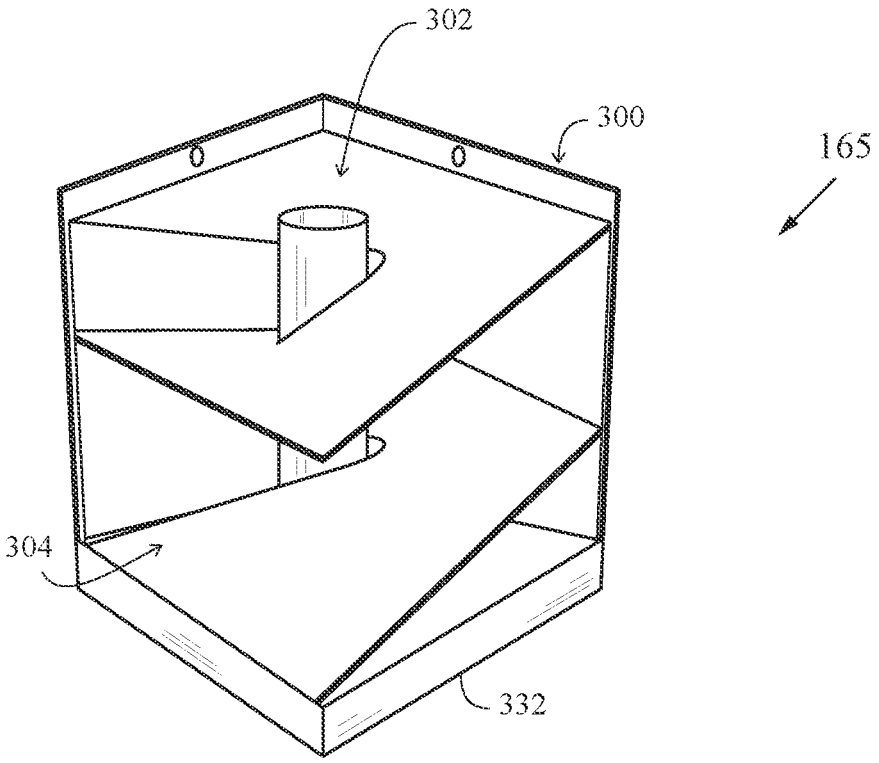
FIG. 3 is a perspective cutaway view of the embodiment of FIG. 4.
Figure 4:
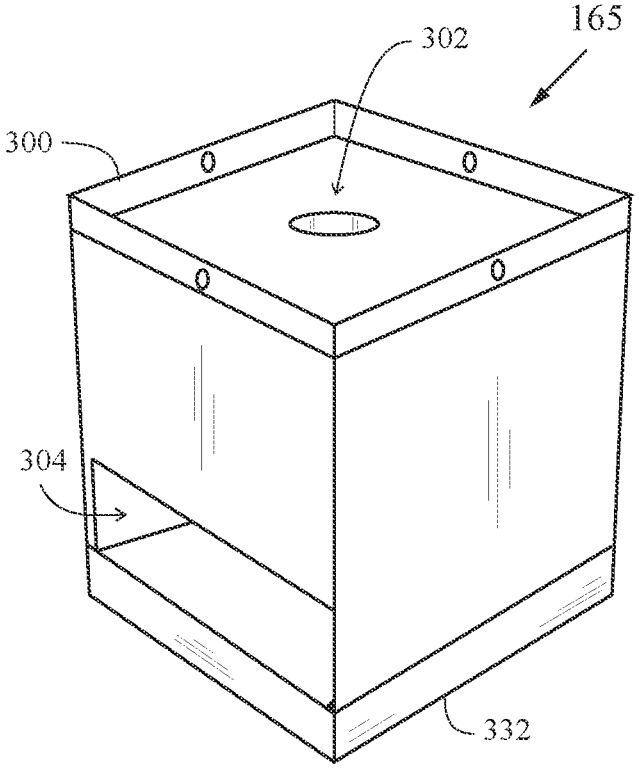
FIG. 4 is a perspective view of an embodiment of the invention.

Another embodiment of an auger ball receiving apparatus 165 is shown in FIGS. 3 and 4, with a square body and a bottom mounted antenna 332.

Figure 7:
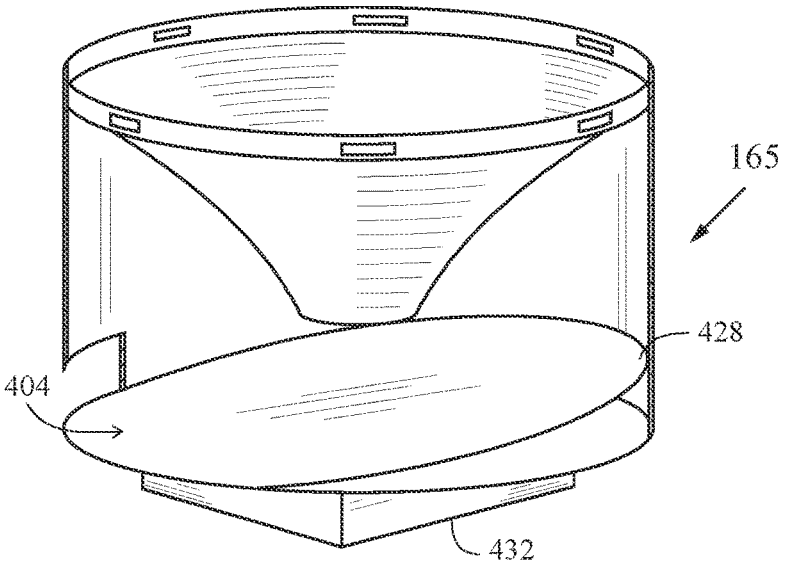
FIG. 7 is a perspective cutaway view of the embodiment of FIG. 6.
Figure 8:
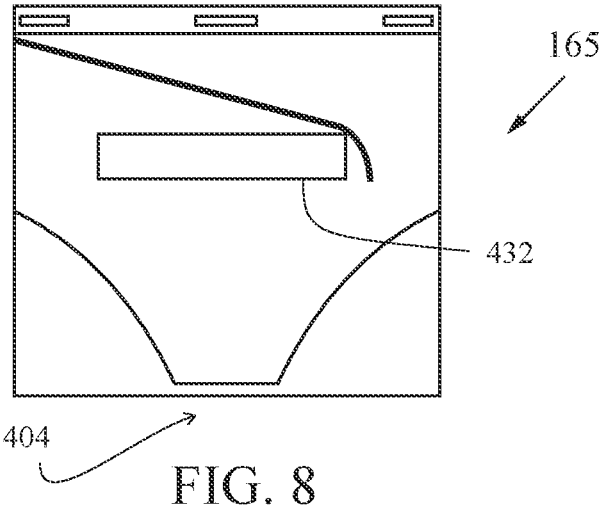
FIG. 8 is a side elevation view of an embodiment of the invention.

Another embodiment is of a ball flush receiving apparatus 165, as shown in FIGS. 5-8. The golf balls 150 leave the apparatus 165 through the egress 404. The apparatus 165 includes a large collection funnel and a bottom mount antenna 432. In FIG. 8, the antenna 432 is mounted near the top.

Figure 9:
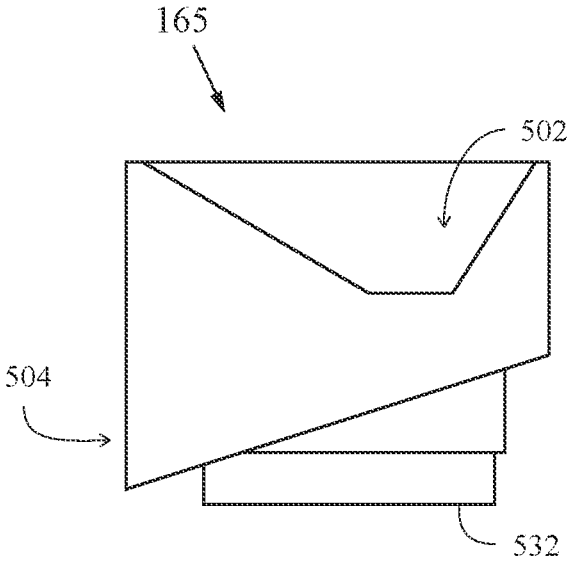
FIG. 9 is a side elevation view of an embodiment of FIG. 10.
Figure 10:
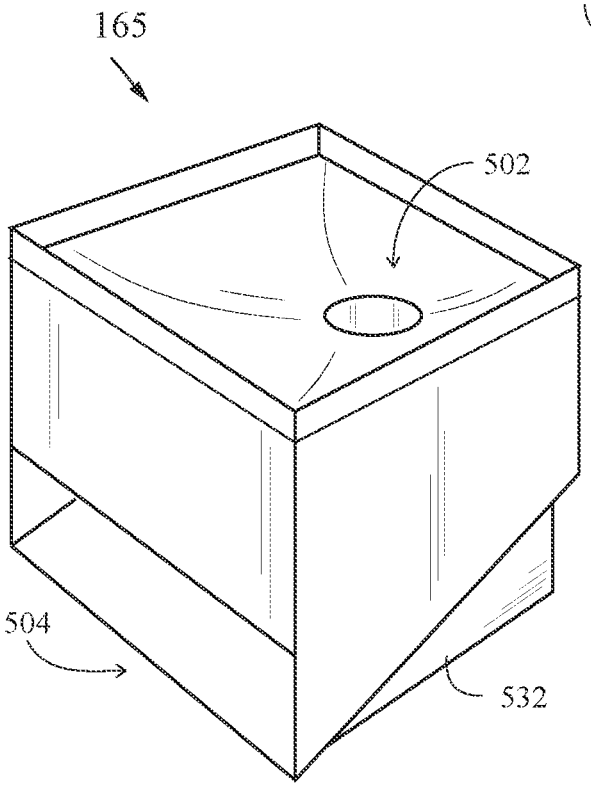
FIG. 10 is a perspective view of an embodiment of the invention.

Another embodiment of a ball flush receiving apparatus 165 is shown in FIGS. 9-10. An offset ball ingress 502 encourages random ball movement.

Figure 11:
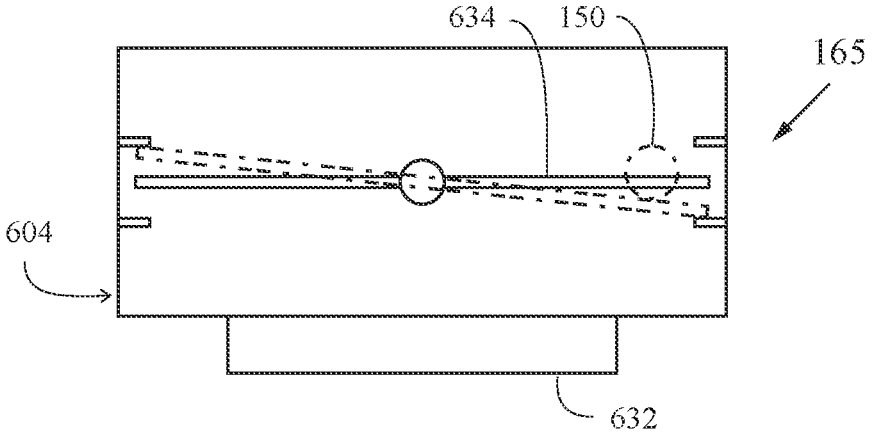
FIG. 11 is a side cutaway view of an embodiment of FIG. 12.
Figure 12:
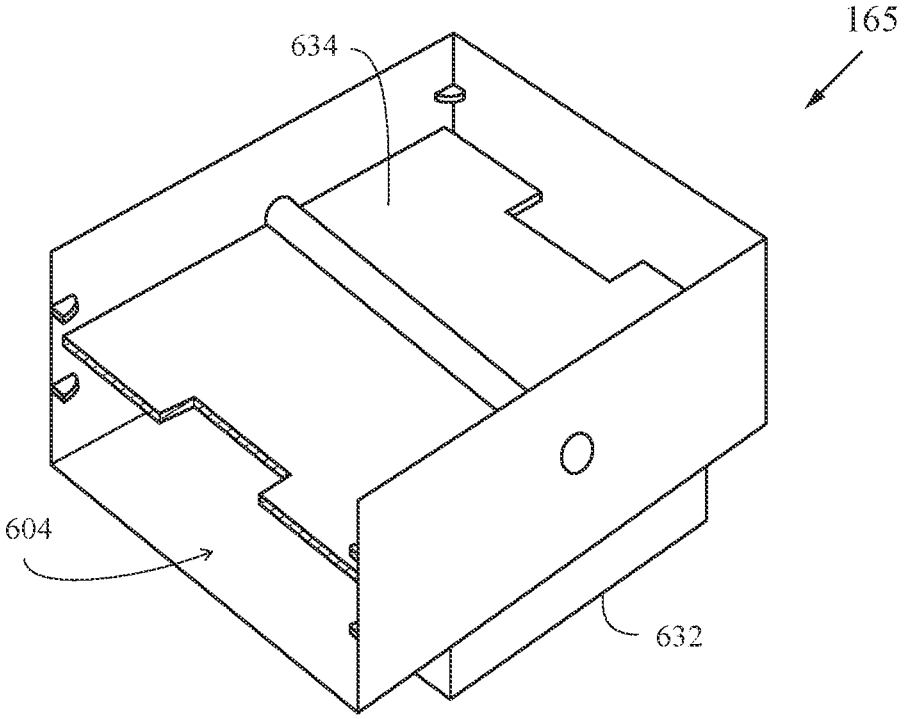
FIG. 12 is a perspective cutaway view of an embodiment of the invention.

Another embodiment is of a flippy plane receiving apparatus 165, as shown in FIGS. 11-12. A ball's 150 weight tips the gimbal plane 634.

Figure 13:
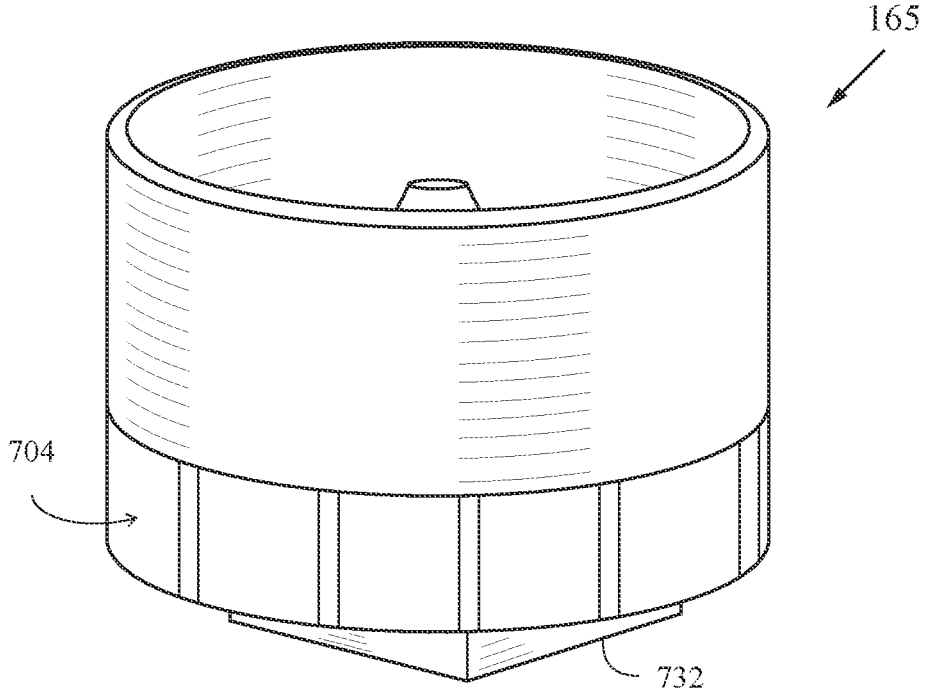
FIG. 13 is a perspective view of an embodiment of the invention.
Figure 14:
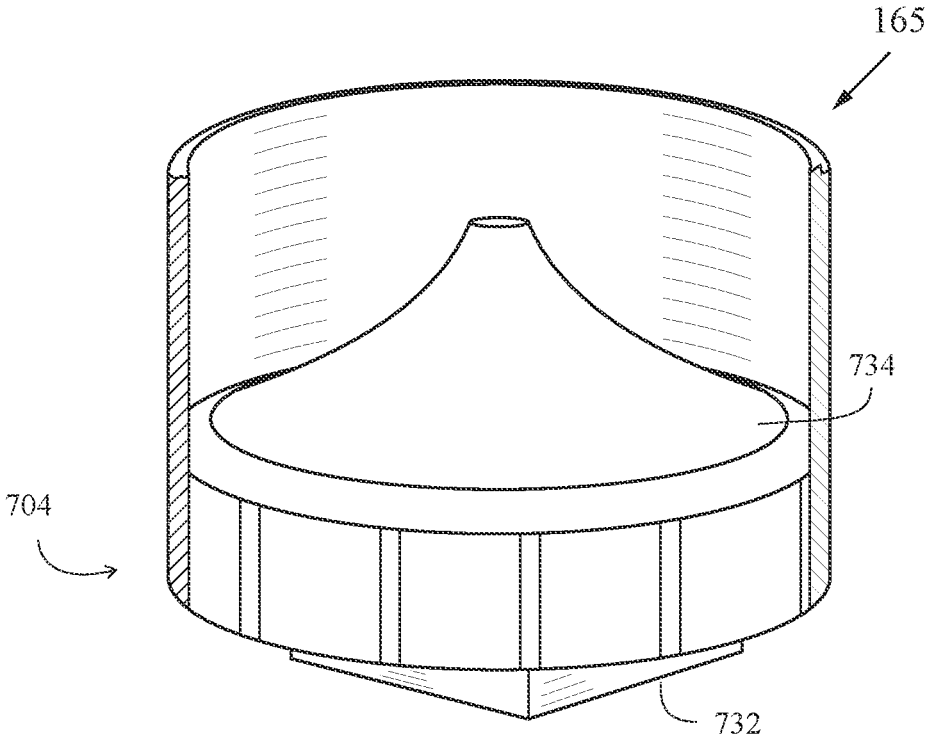
FIG. 14 is a perspective cutaway view of an embodiment of FIG. 13.

Another embodiment is of a cymbal slap receiving apparatus 165, as shown in FIGS. 13-14. A ball's 150 weight tips the cymbal 734. The cymbal 734 can tip in any direction. The ball exit 704 is along the perimeter. The cymbal is balanced on a central post.

Figure 15:
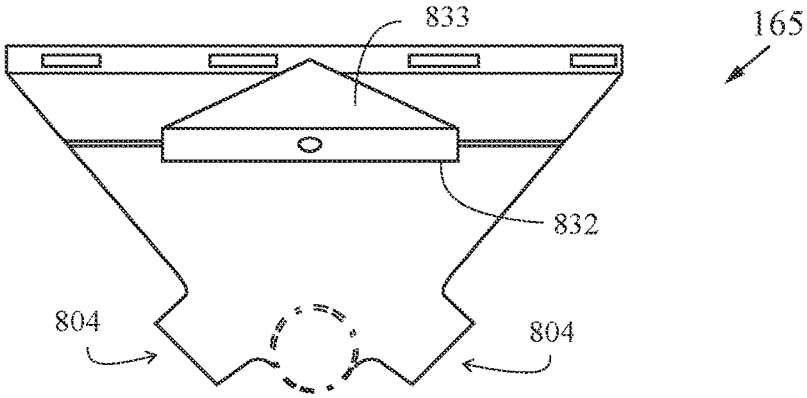
FIG. 15 is a side cutaway view of an embodiment of FIG. 17.
Figure 16:
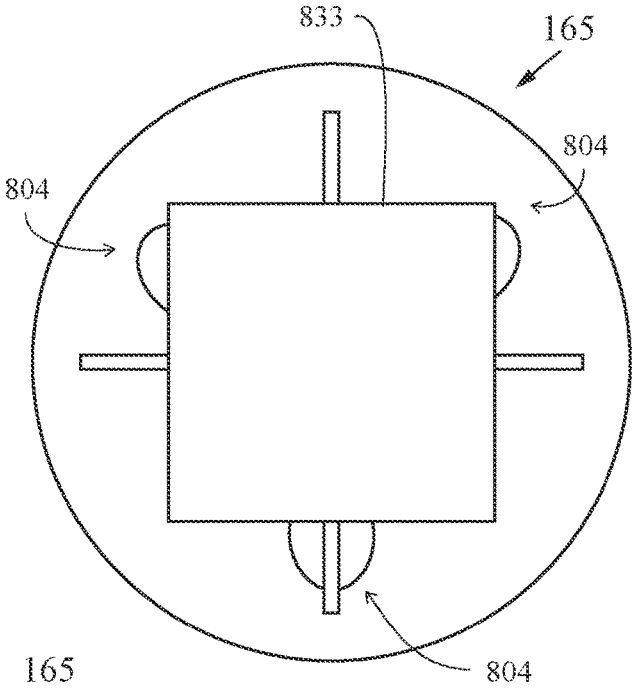
FIG. 16 is a top elevation view of an embodiment of FIG. 17.
Figure 17:
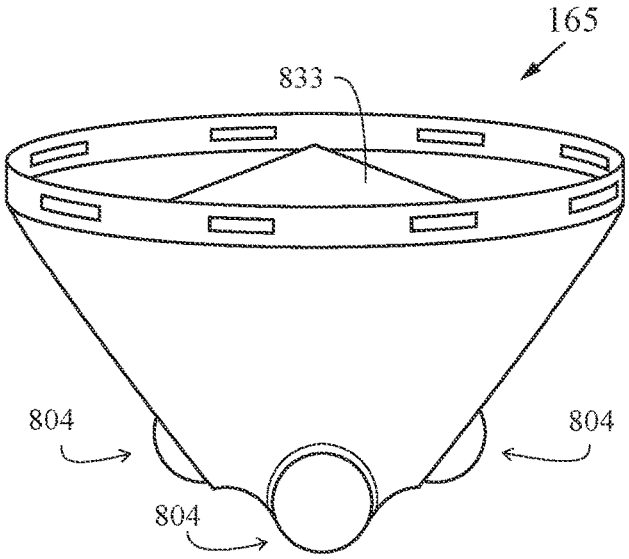
FIG. 17 is a perspective view of an embodiment of the invention.

Another embodiment is of a funnel ball receiving apparatus 165, as shown in FIGS. 15-17, with three ball exits 804. A top mounted antenna 832 includes a protective cover 833.

Figure 5:
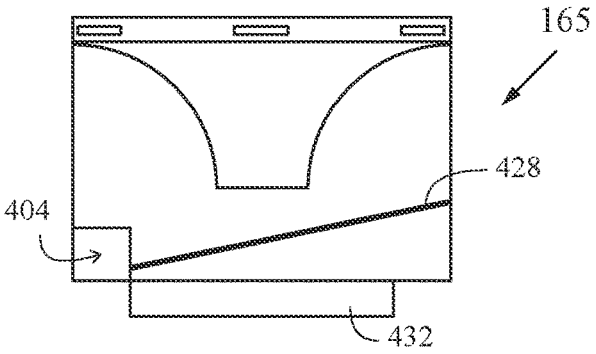
FIG. 5 is a side elevation view of an embodiment of the invention.
Figure 6:
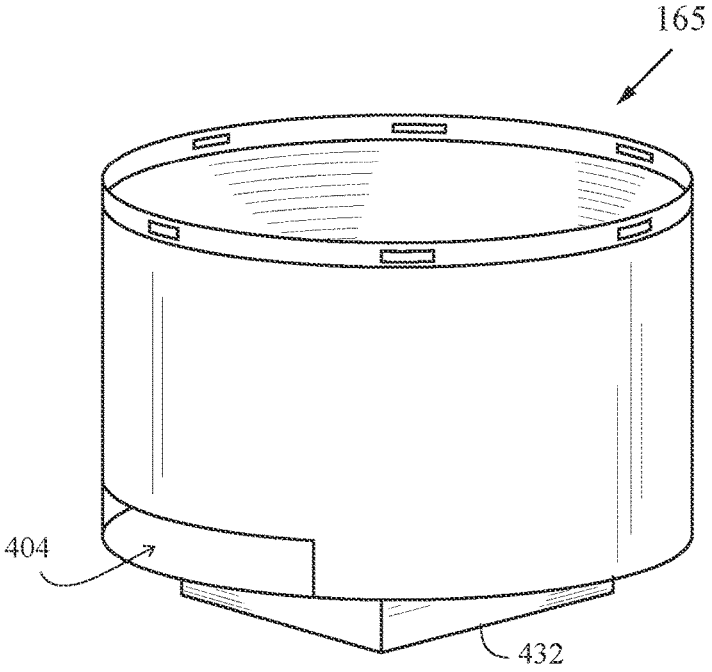
FIG. 6 is a perspective view of an embodiment of the invention.

A bottom support surface 428 within the apparatus 165 can have a first portion, as shown in FIGS. 5 and 7, and a second portion (not shown), where the first portion is sloped downward toward a first of two egresses (if applicable), and the second portion is sloped downward toward a second of the two egresses. In some implementations, the downward slopes of the first and second portions are between 10 and 20 degrees (inclusive) or between 10 and 15 degrees (inclusive). This slope causes the balls 150 to leave the apparatus 165 under the force of gravity even in situations where debris is present or inclement weather tilts the apparatus or where the netting has heterogeneously stretched/aged and tilted the overall assembly. In some implementations, each support surface 428 portion is adjustable, such that the slope can be varied within the range (10-20 or 10-15 degrees) as needed. Note that setting the slope to be as close to the minimum angle needed to avoid jams and backups (and tolerate situations where the apparatus 165 is not level) can facilitate RFID reading of the balls since they will be over the antenna for a longer period of time.

In some implementations, the interior support surface 428 is made of a polymer-based material (e.g., a thermoformed polymer material or plastic sheet), polymer composite, or a combination thereof that protects an antenna from damage. The antenna (an example of antenna 175) is positioned with respect to the read zone such that the balls 150 can be read as they are slowed down by the bars within the body, and optionally by the protuberances on the support surface. In one example, an antenna is placed below the read zone. In some implementations, the apparatus can include one or more antennas placed in different configurations.

FIG. 3 is a perspective, cutaway view of an example of a golf ball receiving apparatus 165. The apparatus 165 includes a body 300 that receives the balls 150 through an ingress 302 and removes the balls 150 through an egress 304. In some implementations, the body 300 has a rectangular shape. In some implementations, the body 300 has a cylindrical shape, as shown in FIGS. 1-2. In some implementations, the body 300 has another geometrically suitable shape. The body 300 can be built using metal, plastic, or other materials, or a combination thereof, but note that the use of metallic materials helps to contain the RF fields so as to prevent the reader from reading balls outside the body 300.

In general, the body can include other features, such as an access door, e.g., the access door for the apparatus can be attached by pivot(s), can be entirely removable from the body, and/or can form a majority of an area of at least one side of the body. Moreover, in some implementations, one or two sides of the apparatus can be left open since the golf balls 150 can be fully contained by two columns of bars/rods. This provides the advantage of decreasing the total weight of the apparatus, which may be hung from the underside of a net funnel, as well as making clearing out any debris (e.g., leaves, windblown trash, and/or snow/ice) that has found its way into the apparatus very simple. In some cases, a person can quickly clear out any debris by simply directing a leaf blower at the apparatus, without having to move or remove any parts of the apparatus.

Thirkettle et al., U.S. Pat. No. 7,056,221 for a Ball Collection Arrangement, is hereby incorporated by reference in its entirety.

Golliffe et al., U.S. Pat. No. 7,059,974 for Golf Balls With Impact Resistant Identification Device, is hereby incorporated by reference in its entirety.

Thirkettle et al., U.S. Pat. No. 7,160,196 for an Identification Device, is hereby incorporated by reference in its entirety.

Thirkettle et al., U.S. Pat. No. 7,337,965 for a Ball Identifying Device, is hereby incorporated by reference in its entirety.

Savarese et al., U.S. Pat. No. 7,691,009 for Apparatus And Methods Relating To Findable Balls, is hereby incorporated by reference in its entirety.

Savarese et al., U.S. Pat. No. 7,766,766 for Methods And Apparatus Relating To Findable Balls, is hereby incorporated by reference in its entirety.

Cheng, U.S. Pat. No. 7,806,777 for Automatically Adapting Virtual Equipment Model, is hereby incorporated by reference in its entirety.

Cheng, U.S. Pat. No. 7,847,808 for Photographic Mapping In A Simulation, is hereby incorporated by reference in its entirety.

Savarese et al., U.S. Pat. No. 8,002,645 for Apparatus, Methods And Systems Relating To Findable Balls, is hereby incorporated by reference in its entirety.

Cheng, U.S. Pat. No. 8,029,359 for Providing Offers To Computer Game Players, is hereby incorporated by reference in its entirety.

Forsgren, U.S. Pat. No. 8,077,917 for Systems And Methods For Enhancing Images in A Video Recording of A Sports Event, is hereby incorporated by reference in its entirety.

Caster et al., U.S. Pat. No. 9,132,326 for a System For Providing Loaner Clubs To Novice Golfers, is hereby incorporated by reference in its entirety.

Forsgren, U.S. Pat. No. 10,596,416 for a System And Method For Three Dimensional Object Tracking Using Combination of Radar And Image Data, is hereby incorporated by reference in its entirety.

Semsak et al., U.S. Pat. No. 10,799,770 for a RFID Golf Ball Testing Apparatus, is hereby incorporated by reference in its entirety.

Johanssson et al., U.S. Pat. No. 10,898,757 for Three Dimensional Object Tracking Using Combination of Radar Speed Data And Two Dimensional Image Data, is hereby incorporated by reference in its entirety.

Forsgren et al., U.S. Pat. No. 11,335,013 for Three Motion Based Pre-Processing Of Two-Dimensional Image Data Prior To Three-Dimensional Object Tracking With Virtual Time Synchronization, is hereby incorporated by reference in its entirety.

Levin, U.S. Pat. No. 11,409,411 for a Single Finger User Interface Camera Control, is hereby incorporated by reference in its entirety.

Johansson et al., U.S. Pat. No. 11,504,582 for Three Dimensional Object Tracking Using Combination of Radar Speed Data And Two Dimensional Image Data, is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A system for identifying a golf ball hit on a range having multiple targets, the system comprising:

a target collection member positioned on the range;

a ball detection member comprising a housing, a cover, and a helical track within the housing, wherein the cover comprises at least one hole for access to the helical track, wherein the housing and cover are composed of a metal material; and an antenna positioned at a bottom of the housing and below the helical track;

wherein the antenna is configured to detect a golf ball comprising a wireless transmitter;

wherein the housing and cover composed of a metal material prevents the antenna from reading golf balls outside of the ball detection member.

2. The system according to claim 1 wherein the helical track traverses 360 degrees around a central post within the housing.

3. The system according to claim 1 wherein the housing is cylindrical in shape.

4. The system according to claim 1 wherein the housing is square in shape.

5. The system according to claim 1 wherein the housing is circular in shape.

6. The system according to claim 1 wherein the wireless transmitter in the golf ball is an RFID passive antenna.

7. The system according to claim 1 wherein the antenna is a RFID antenna.

8. A golf ball identification apparatus comprising:

a housing composed of a metal material;

a cover composed of a metal material;

a helical track within the housing, wherein the cover comprises a plurality of holes for access to the helical track; and an antenna positioned at a bottom of the housing and below the helical track;

wherein the antenna is configured to detect a golf ball comprising a wireless transmitter;

wherein the housing and cover composed of a metal material prevents the antenna from reading golf balls outside of the golf ball identification apparatus.

9. The golf ball identification apparatus according to claim 8 wherein the helical track traverses 360 degrees around a central post within the housing.

10. The golf ball identification apparatus according to claim 8 wherein the housing is cylindrical in shape.

11. The golf ball identification apparatus according to claim 8 wherein the housing is square in shape.

12. The golf ball identification apparatus according to claim 8 wherein the housing is circular in shape.

13. The golf ball identification apparatus according to claim 8 wherein the wireless transmitter in the golf ball is an RFID passive antenna.

14. The golf ball identification apparatus according to claim 8 wherein the antenna is a RFID antenna.

* * * * *